US009526322B2

(12) United States Patent
Moreau et al.

(10) Patent No.: US 9,526,322 B2
(45) Date of Patent: Dec. 27, 2016

(54) TOOL HOLDER WITH CYLINDRICAL HOLDER BODY

(71) Applicant: Ty-Flot, Inc., Manchester, NH (US)

(72) Inventors: Darrell A. Moreau, Derry, NH (US); Andre W. Moreau, Bedford, NH (US)

(73) Assignee: Ty-Flot, Inc., Manchester, NH (US)

( * ) Notice: Subject to any disclaimer, the term of this patent is extended or adjusted under 35 U.S.C. 154(b) by 0 days.

(21) Appl. No.: 14/686,839

(22) Filed: Apr. 15, 2015

(65) Prior Publication Data

US 2015/0216290 A1 Aug. 6, 2015

Related U.S. Application Data

(63) Continuation-in-part of application No. 14/045,953, filed on Oct. 4, 2013, which is a continuation-in-part of application No. 29/465,784, filed on Aug. 30, 2013, now Pat. No. Des. 718,596, and a continuation-in-part of application No. 29/465,881, filed on Sep. 3, 2013, now Pat. No. Des. 718,597, and a continuation-in-part of application No. 29/465,886, filed on Sep. 3, 2013, now Pat. No. Des. 718,598.

(51) Int. Cl.

| | |
|---|---|
| ***A45F 5/14*** | (2006.01) |
| ***B25H 3/00*** | (2006.01) |
| ***A45F 5/02*** | (2006.01) |
| *A45F 5/00* | (2006.01) |

(52) U.S. Cl.

CPC ..... *A45F 5/14* (2013.01); *A45F 5/021* (2013.01); *B25H 3/00* (2013.01); *A45F 2005/006* (2013.01)

(58) Field of Classification Search

CPC ..... A45F 5/14; A45F 5/021; A45F 2005/006; B25H 3/00

USPC ..... 206/349, 207; 24/3.1; 224/191, 251, 250

See application file for complete search history.

(56) References Cited

U.S. PATENT DOCUMENTS

| | | | | |
|---|---|---|---|---|
| 1,507,590 | A * | 9/1924 | Flagg | A45B 1/04 248/690 |
| 2,212,049 | A * | 8/1940 | Ryland | A47F 5/0006 220/758 |
| 2,258,263 | A * | 10/1941 | Rothenberg | F21L 15/08 16/444 |
| 2,294,661 | A * | 9/1942 | Hibbard | B25G 3/00 16/433 |

(Continued)

*Primary Examiner* — King M Chu

(74) *Attorney, Agent, or Firm* — Mesmer & Deleault PLLC; Ross Krutsinger

(57) ABSTRACT

A tool holder has a holder body with a generally cylindrical sidewall extending along a central longitudinal axis between an open first end and a second end portion. The second end portion defines a through-opening extending along the central longitudinal axis and having a through-opening radius. A flange member extends axially from the second end portion and has flange neck portion and a flange rim portion each extending radially about the through-opening. The flange rim portion is spaced apart from and connected at the flange neck portion to the second end portion of the holder body. A reinforcing member installed on the flange neck portion between the flange rim portion and the second end portion. The holder body is made of a resilient, pliable material and constructed to receive and frictionally engage a non-working end of a tool inserted into the holder body through the open first end.

15 Claims, 9 Drawing Sheets

(56) References Cited

U.S. PATENT DOCUMENTS

| | | | | | |
|---|---|---|---|---|---|
| 4,591,156 | A * | 5/1986 | Attenni | A63B 49/08 | 224/219 |
| 5,405,210 | A * | 4/1995 | Tsui | B21K 1/72 | 403/119 |
| 6,854,681 | B2 * | 2/2005 | Kish | A45F 5/004 | 224/162 |
| 2010/0229347 | A1 * | 9/2010 | Kish | A45F 5/00 | 24/3.1 |

* cited by examiner

TOOL HOLDER WITH CYLINDRICAL HOLDER BODY

BACKGROUND OF THE INVENTION

1. Field of the Invention

The present invention relates generally to hand tools and accessories. More particularly, the present invention relates to a tool holder for hand tools and other objects.

2. Description of the Prior Art

Hand tools are widely used in construction, maintenance, and industrial facilities operations. The user of a tool often stores tools in a bag, box, pouch, or tool belt when the tool is not being used. The user then selects the appropriate tool for a given task and returns the tool to its storage location after the task is complete. For tasks performed at elevated heights, dropping a tool can cause injury to individuals or damage to objects below the worker. The dropped tool also is a significant inconvenience for workers who must spend time to retrieve the dropped tool.

One method of addressing the problem of dropped tools has been to mold a sleeve snugly over and taking the shape of the tool's handle or grip. The sleeve has a solid end with an opening in the solid end through which a tether may be attached. For example, one line of tools includes hammers, hinged pliers, and adjustable spanners that have a rubber sleeve molded over the handle of the tool with a solid end portion of the sleeve extending beyond the end of the handle. A ring passes through an opening or grommet in the solid end portion of the rubber sleeve. The user clips one end of a lanyard to the ring and attaches the other end of the lanyard to the user's tool belt, scaffolding, ladder, or other object.

Another approach to preventing dropped tools is disclosed in U.S. Pat. No. 6,216,319 to Elkins for a hardware receptacle. The receptacle is a cylindrically-shaped rubber cap with an open end and a closed end. The receptacle is adapted to fit over the end of tools and pieces of hardware of different sizes and generally has a thin wall so as to be pliable and moldable to the various tools and components. Holes extend through the closed end of the receptacles to provide vents that help alleviate suction that may occur when removing a tool or piece of hardware from the receptacles, thus making it easier to remove the hardware.

A further approach to preventing dropped tools is disclosed in US published application no. 2010/0229347-A1 to Kish. The Kish published application discloses a holder adapted to be attached to a tool to prevent a dropped tool from being lost or forgotten during use. The holder has a hollow member with an open end and a closed end. The closed end has a centrally-located opening through which a swivel connector is attached. The hollow member is made of rubber or plastic and the wall of the hollow member frictionally engages or grips a tool located in the hollow member.

SUMMARY OF THE INVENTION

One limitation of the above-described approaches to tool holders is that a connector attached through an opening or eyelet formed in the end of a rubber sleeve requires a separate swivel-type connector in order to prevent the line from becoming coiled during use. This is because the sleeve is molded over the tool handle so it does not rotate or move relative to the tool. A further consequence is that molded sleeves generally cannot be removed from the tool and reused effectively on the same or a different tool.

Cylindrical members that are slipped over the end of a tool handle, such as described in the Kish published application, can be difficult to remove from the tool because of a tight fit or vacuum formed between the handle and the closed end of the cylindrical member. The tight fit also makes it difficult for the user to break the holder's seal on the tool or reduce the grip on the tool.

In other similar tool holders having cylindrical members, the frictional grip of the cylindrical member is reduced so that the holder is easier to remove from a tool. However, this change makes the tool holder's grip insufficient to hold heavier tools or the holder becomes unreliable because frictional engagement alone is not enough to maintain the cylindrical member on the tool handle when the tool is inadvertently dropped.

Yet another deficiency of prior art tool holders is that a connector attached through and opening in the closed end may itself be pulled through the opening when used on heavier tools. This failure is sometimes a result of the resilient material of the cylindrical member becoming stretched when subjected to force, where the opening expands to allow the connector to pass through the opening.

Therefore, what is needed is an improved tool holder for hand tools and other objects. The present invention achieves this and other objectives by providing a tool holder including a holder body with a generally cylindrical sidewall, an open first end, and a second end. In some embodiments, the second end is closed. In other embodiments, the second end defines a through opening extending axially through the second end. The holder body is made of a flexible and resilient material adapted to receive and conform to a handle or non-working end of a tool inserted along a central longitudinal axis into the first end of the holder body. In some embodiments, a rotatable connector is coupled to the second (closed) end of the holder body. To assist in adjusting the holder body and/or breaking a seal formed between the holder body and the tool, some embodiments of the holder body have one or more tabs that extend axially away from the first end of the sidewall. The holder body may additionally or alternately have at least one suction cup on an inside surface of the sidewall.

In another embodiment, the second end of the holder body defines an end opening therethrough. The tool holder includes a connector assembly with a disk member having a substantially planar face sized to abut an inside surface of the second end portion of the holder body and a shaft extending perpendicularly from the disk member and axially through the end opening of the holder body. A tether connector, such as a loop or eyelet, is coupled to the shaft or disk member.

In another embodiment, the tether connector is configured to rotate about the central longitudinal axis and configured to pivot about a pivot axis extending transversely to the shaft. The feature of the tether connector pivoting about a pivot axis is an advantage of the present invention because it permits the tether connector to fold down on either side at the closed end of the holder body. This feature minimizes interference with the usefulness of the tool holder by making hand use more comfortable since the tether connector does not stick out or extend axially from the closed end when pivoted into the fold down position. Another advantage of the pivoting action of the tether connector is that when it is in a fold down position, it serves as an anti-roll mechanism. Where the outer bounds of the tether connector extend beyond the outer circumference of the holder body at the second end, the tether connector in a fold down position prevents a tool such as screwdriver from continuously rolling along a surface when the tool with the tool holder is placed on a flat surface.

In another embodiment, the tether connector has a first end and a second end aligned with one another and separated by a predefined distance. The tether connector may take many forms, such as an open D-ring connector or a flexible length of cable, for example. The tether connector's first end has an enlarged first-end portion and the second end has an enlarged second-end portion. The connector assembly also includes an upper disk member with a centrally-located opening that is sized to receive the shaft. The upper disk member has a top surface defining an annular recess. The connector assembly further includes a cap member with a cap aperture extending axially therethrough, a top surface, and a bottom surface. The bottom surface defines at least one (e.g., a pair) of tether connector recesses opposite the cap aperture and each sized to at least partially receive the enlarged first-end portion and the enlarged second end-portion, respectively, of the tether connector. The cap member is rotatable about the shaft with the enlarged first-end portion and the enlarged second-end portion of the tether connector each disposed between the respective connector recess and the annular recess of the upper disk member.

In another embodiment, the shaft is a split shaft and defines a catch surface extending radially from the shaft at a head portion. The shaft therefore creates a snap fit with the cap member when the catch surface is pressed into the cap aperture in a compressed state and allowed to expand to its uncompressed state upon passing through the cap aperture.

In another embodiment, the connector assembly is retained coupled to the holder body with a feature such as a nut threaded onto the shaft, a retaining ring installed on the shaft, a snap fit with the holder body, a snap fit with a member other than the holder body, an opening through the shaft and a connector extending through the opening, or an enlargement on the shaft that abuts an outside surface of the closed end of the holder body.

In another embodiment, an inside surface of the closed end is concave.

In another embodiment, the sidewall tapers in a range of about 1 degree to about 2 degrees away from the central longitudinal axis of the holder body from the closed end to the open end of the holder body.

In another embodiment, the holder body has two tabs spaced about 180° from one another.

In another embodiment, the tab(s) does (do) not extend radially beyond an outer surface of the holder body. The tabs can be used to break a suction or air-tight seal with the tool handle when one or more tab is pulled radially away from the tool handle with a predefined force, thereby at least partially separating the suction cup(s) from the tool. The tabs can also or alternately be used to release frictional engagement with the tool when one or more tab is pulled radially away from the tool with a predefined force, thereby at least partially separating the inside surface of the holder body from the tool.

In another embodiment, the holder body has a plurality of suction cups on the inside surface. For example, a plurality of suction cups are spaced from one another and distributed about the inside surface of the holder body. In one embodiment, the plurality of suction cups are evenly distributed about the inside surface.

In another embodiment, a holder body has a generally cylindrical sidewall extending along a central longitudinal axis between an open first end and a second end portion. The second end portion defines a through-opening extending along the central longitudinal axis and having a through-opening radius. A flange member extends axially from the second end portion and has flange neck portion and a flange rim portion each extending radially about the through-opening. The flange rim portion is spaced apart from and connected at the flange neck portion to the second end portion of the holder body. A reinforcing member installed on the flange neck portion between the flange rim portion and the second end portion. The holder body is made of a resilient, pliable material and constructed to receive and frictionally engage a non-working end of a tool inserted into the holder body through the open first end.

In another embodiment, the tool holder includes a tether connector assembly that includes a shaft member extending through the through-opening of the second end portion from a proximal end located in the holder body to a distal end located beyond the flange member. A protrusion at the proximal end of the shaft member extends radially from the shaft member and has a protrusion surface shaped to engage the inside surface of the second end portion of the holder body. In another embodiment, the protrusion is a disk-shaped member having a substantially planar face sized to abut the inside surface of the second end portion of the holder body. A tether connector is attached adjacent the distal end and is configured to be attached to a tether. For example, the tether connector has a closed loop.

In another embodiment, the connector assembly includes an annular upper disk member installed on the shaft member between the second end portion and the tether connector. In some embodiments, the upper disk member includes one or more feet extending axially from the bottom surface. In embodiments where the second end portion of the holder body defines one or more corresponding feet openings, the foot (feet) extend from the upper disk member into or through the corresponding feet opening(s). In one embodiment, the second end portion defines a plurality of feet openings spaced apart from each other in an array about the through-opening through the second end portion. For example, the second end portion of the holder body has four feet openings arranged in a circle about the through opening and the upper disk member has four corresponding feet that extend into or through the feet openings. In some embodiments, the feet extend to abut the protrusion at the proximal end of the shaft member.

In one embodiment, the reinforcement member is generally annular and is installed about the flange neck between the flange rim portion and the second end portion of the holder body. In another embodiment, the reinforcement member is a closed ring sized to fit snugly between the second end portion and the flange rim portion. In another embodiment, the reinforcement member defines an annular recess sized to receive the flange rim portion therein.

In another embodiment, the reinforcement member is installed between the flange and the second end of the holder body, such as being installed around the flange post or neck. Since the holder body is made of a pliable material, the flange and reinforcement member prevent the tether connector assembly from being separated from the holder body by the protrusion being forcibly pulled through the through-opening in the second end of the holder body. In some embodiments, the reinforcement member is a closed ring, a split ring, a circlip, plate with a slot, or a ring of expandable size that can be expanded for installation and then allowed to return to a smaller size after being positioned about the flange post. In some embodiments, the reinforcement member is generally annular and defines a central recess sized to receive the flange rim portion of the flange member.

A method of securing a tool to a tether includes providing a tool holder having a holder body with a generally cylindrical sidewall, an open end, and a closed end, where the holder body is adapted to receive a non-working end of a tool inserted into the open end along a central longitudinal axis of the sleeve holder. A tether connector is coupled to the closed end of the holder body. The holder body has at least one tab extending axially away from an open end of the sidewall, and/or at least one suction cup on an inside surface of the sidewall. The method also includes the step of inserting the non-working end of the tool into the open end of the holder body a distance sufficient to establish a frictional grip between the holder body and the tool. A first end of the tether is connected to the tether connector. Preferably, the frictional grip and/or a vacuum seal formed by the suction cup(s) is sufficient to retain the tool holder on the tool when the tool holder is connected to a tether and the tool is inadvertently dropped.

In another embodiment, the method includes pulling one or more tab radially away from the non-working end of the tool to break the frictional grip between the holder body and the tool and the step of removing the tool from the holder body.

DETAILED DESCRIPTION OF THE PREFERRED EMBODIMENT

Figure 1:
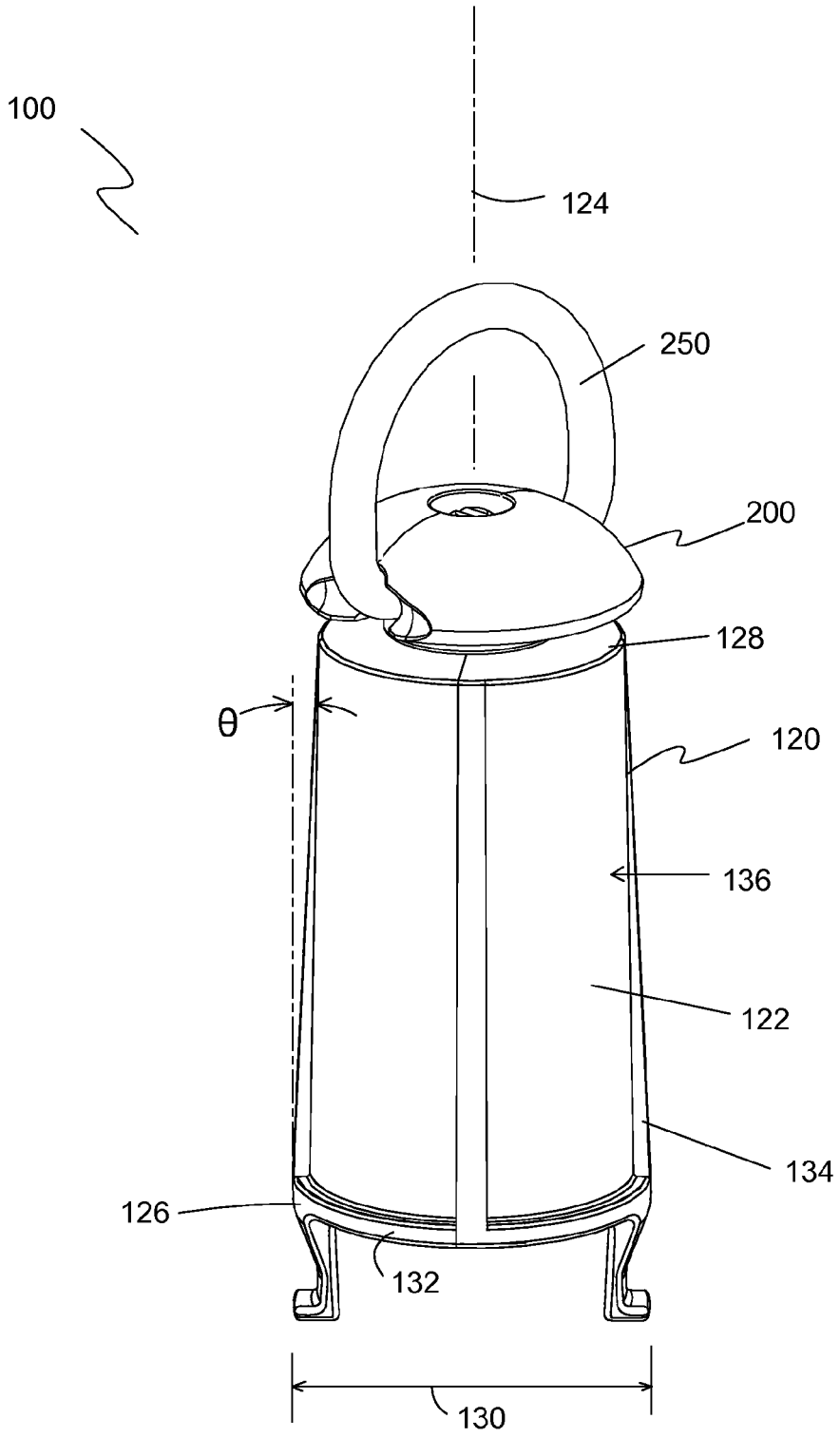
FIG. 1 illustrates a perspective view of one embodiment of tool holder having a sleeve and connector assembly.

The preferred embodiments of the present invention are illustrated in FIGS. 1-13. FIG. 1 illustrates a perspective view of one embodiment of a tool holder 100 with a holder body 120 and a connector assembly 200 with a tether connector 250. Holder body 120 is hollow with a generally cylindrical sidewall 122 extending along a central longitudinal axis 124. Holder body 120 has an open first end 126 and a second end 128. In some embodiments, second end 128 is closed; in other embodiments second end 128 defines a through opening. In one embodiment, sidewall 122 tapers down in diameter 130 from first end 126 to second end 128. The taper is in a range of about one degree to about two degrees relative to the longitudinal axis 24. In one embodiment, sidewall 122 defines an angle θ of about 1.25° with an axis 500 that is parallel to central longitudinal axis 124. The taper or angle θ of sidewall 122 is for ease of manufacture, such as in injection molding, and also provides a slightly larger diameter 130 at first end 126 for inserting the end of a tool 300 (shown in FIG. 7) into holder body 120. Holder body 120 is made of a flexible and resilient material, such as rubber or plastic.

Holder body 120 preferably has an optional rim 132 at first end 126. Rim 132 is a portion of holder body 120 that protrudes radially outward from outside surface 136 of holder body 120. In one embodiment, rim 132 is formed by a region of increased thickness at first end 126. Rim 132 minimizes tearing of holder body 120 when being stretched over a tool handle or when being removed from a tool handle. Rim 132 also provides an edge for the user to grasp when adjusting the fit of or removing holder body 120 from a tool handle.

In one embodiment, holder body 120 has a plurality of ribs 134 extending axially between first end 126 and second end 128. Preferably, ribs 134 extend from rim 132 to second end 128. Ribs 134 provide rigidity to holder body 120 and reduce twisting of holder body 120 when subjected to torsional forces.

Figure 2:
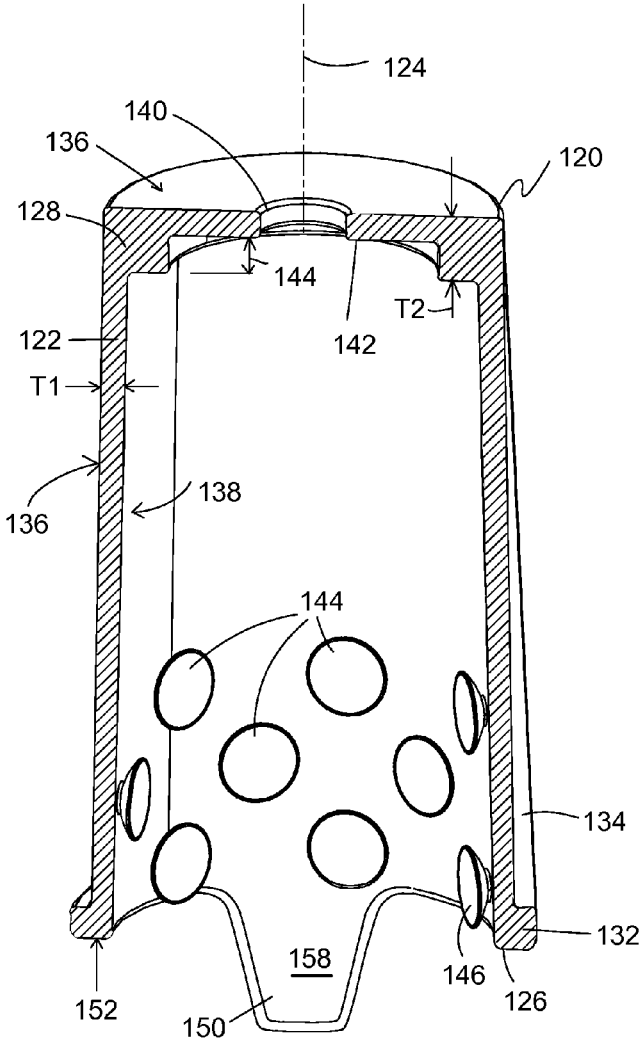
FIG. 2 illustrates a cross-sectional, perspective view of one embodiment of a holder body of the present invention showing suction cups on the inside surface and tabs extending from a lower end of the holder body.

Turning now to FIG. 2, a cross-sectional, perspective view is illustrated of a longitudinal section of holder body 120, where the section is taken vertically through holder body 120 along central longitudinal axis 124. In one embodiment, ribs 134 are substantially flush with outside surface 136 of holder body 120 at or near second end 128 and then gradually increase in thickness and protrude from outside surface 136 so that ribs 134 are substantially flush with rim 132 at first end 126.

Sidewall 122 has a wall thickness T1 between outside surface 136 and inside surface 138. In one embodiment, wall thickness T1 is substantially the same from rim 132 to second end 128 (excluding ribs 134 and rim 132). In another embodiment, wall thickness T1 tapers slightly from second end 128 to first end 126 (excluding ribs 134 and rim 132). A tapered wall thickness T1 makes holder body 120 more pliable towards first end 126 and less pliable towards second end 128. A difference in pliability makes holder body 120 easier to install or remove from a tool handle due to the ability to more easily stretch or deform holder body 120 towards first end 126. Where wall thickness T1 is greater towards second end 128, the reduced pliability at second end 128 provides for a stronger grip on tool 300 (shown in FIG. 7) when holder body 120 is positioned (sometimes forced) onto tool 300.

Second end portion 129 has an end thickness T2 between outside surface 136 and inside surface 138. In one embodiment, end thickness T2 is greater than wall thickness T1. In one embodiment, inside surface 138 at second end 128 is concave to more snugly fit to a rounded end of a tool handle. Optionally, an eyelet or connector tab (not shown) is formed integrally with holder body 120 and connected on outside surface 136 of second end 128.

In one embodiment, second end 128 defines an end aperture 140 extending axially through second end 128. End aperture 140 is preferably centrally located or centered on central longitudinal axis 124 but may optionally be positioned off-center of second end 128. When holder body 120 has end aperture 140, holder body optionally defines an end recess 142 with a recess depth 144 into inside surface 138 of second end 128. End recess 142 provides a seat for a disk member 210 of connector assembly 200, which is shown in FIG. 5 and discussed in more detail below.

Figure 3:
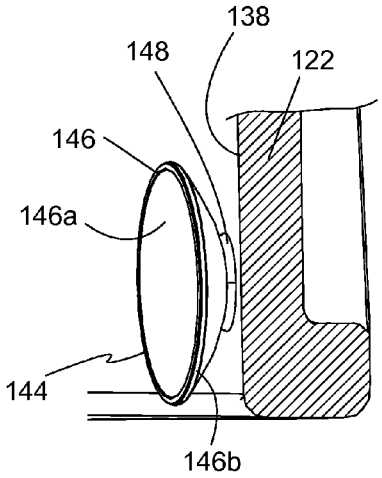
FIG. 3 illustrates an enlarged perspective view of one embodiment of a suction cup of the present invention.

Holder body 120 may optionally include one or more suction cups 144 on inside surface 138. FIG. 3 illustrates an enlarged, side perspective view of one embodiment of suction cup 144 as also shown in FIG. 2. In one embodiment, suction cup 144 has a cup portion 146 extending from a neck portion 148 connected to inside surface 138 of holder body 120. Cup portion 146 has a concave inside cup surface 146*a* encircled by a cup rim 146*b*. Suction cups 144 may alternately be formed in sidewall 122 where inside cup surface 146*a* is recessed into inside surface 138 of sidewall 122 and cup rim 146*b* is flush with or protrudes radially inward from inside surface 138 of sidewall 122. In one embodiment, holder body 120 has a plurality of suction cups 144 arranged in an array on inside surface 138, such as three rows of suction cups distributed in a checkerboard pattern around inside surface 138 adjacent first end 126 of holder body 120. The plurality of suction cups 144 provides for an increased grip on a tool handle due to the combination of vacuum and friction forces acting together.

Figure 4:
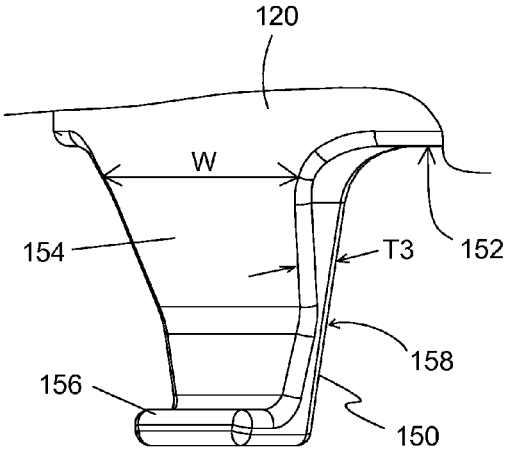
FIG. 4 illustrates an enlarged perspective view of one embodiment of a tab of the present invention.

Turning now to FIG. 4 and with continued reference to FIG. 2, one embodiment of holder body 120 has at least one ear or tab 150 extending axially from open end margin 152. FIG. 4 illustrates an enlarged, front perspective view of one embodiment of tab 150, which is also shown in other views in FIGS. 1 and 2. In one embodiment, tab 150 has a body portion 154 connected to the first end 126 of side wall 122 and a foot portion 156 connected to body portion 154. Body portion 154 preferably tapers in width W and tab thickness T3 from its connection at open end margin 152 to foot portion 156. Foot portion 156 extends transversely outward from body portion 154 to be grasped by the user. In one embodiment, foot portion 156 extends perpendicularly from body portion 154. Other shapes for tabs 150 are also acceptable, such as rectangular or rounded. Inside surface 158 of tab 150 is preferably continuous with and seamless with inside surface 138 of holder body. Although tabs 150 may extend radially beyond the outer most diameter of rim 132, it is preferable that tabs 150 do not extend radially beyond the outer most diameter of rim 132 of holder body 120 or the outer most diameter of holder body 120 if optional rim 132 is omitted, as the case may be.

Figure 5A:
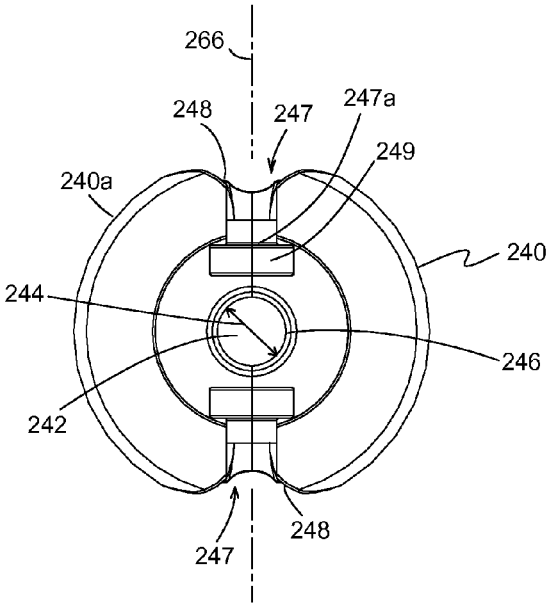
FIG. 5A illustrates a top hidden-line view of one embodiment of a cap member of the present invention showing connector recesses and side openings.
Figure 5:
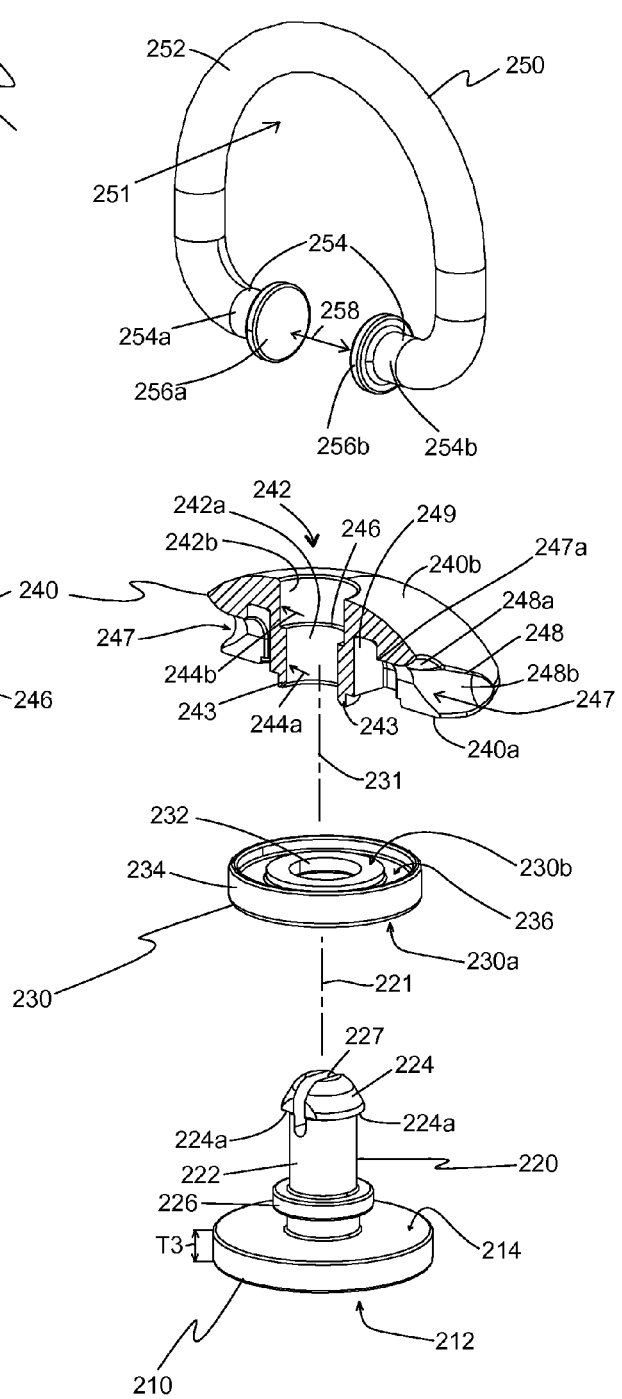
FIG. 5 illustrates an exploded, perspective view of one embodiment of a connector assembly of the present invention.

Turning now to FIG. 5, one embodiment of connector assembly 200 is shown in an exploded, perspective view. Here, connector assembly 200 includes a disk member 210, a shaft 220 connected to and extending substantially perpendicular from disk member 210, an upper disk member 230, a cap member 240, and a tether connector 250.

In one embodiment, disk member 210 is a round plate with a disk thickness T4 between a bottom surface 212 and a substantially planar top face 214. Top face 214 is preferably substantially featureless and is sized to engage inside surface 138 of second end 128 of holder body 120 (shown in FIGS. 1-2) with shaft 220 extending through end aperture 140 of holder body 120. In one embodiment, disk thickness T4 is approximately equal to or less than recess depth 144 of end recess 142 in holder body 120 (shown in FIG. 2).

In one embodiment, shaft 220 has a cylindrical shaft body 222 extending along a shaft axis 221 with a shaft head 224 at one end, and a shaft protrusion 226 on shaft body 222 a predefined distance from top face 214 of disk member 210. Shaft head 224 is preferably a split head having a transverse slot 227 extending axially into shaft head 224 and, in some configurations, also into shaft body 222. Shaft head 224 preferably has a domed shape to facilitate insertion through openings and to cause compression of a split shaft head 224. In one embodiment, shaft head 224 has at least one catch surface 224*a* that extends radially outward from shaft body 222. The split-head configuration and catch surface 224*a* enables a snap fit where shaft head 224 compresses during insertion through an opening of slightly smaller diameter and then expands to its uncompressed shape after passing through the opening. After returning to its uncompressed shape, catch surface 224*a* engages the material around the opening to prevent shaft 220 from passing back through the opening in the opposite direction. In one embodiment, shaft protrusion 226 is positioned along shaft body 222 so that it is forcibly pushed through end aperture 140 and positioned against the outside surface 136 of end aperture 140 (shown in FIG. 2) when top face 214 abuts inside surface of holder body 120 (shown in FIG. 2). Preferably, shaft protrusion 226 is positioned on shaft body 222 so that it abuts or nearly abuts outside surface 136 of second end 128 of holder body 120 when top face 214 of disk member 210 abuts inside surface 138 of second end 128. Shaft 220 may be connected to disk member 210 by welding, threaded engagement, being integrally formed as one piece with disk member 210, or other known methods. Shaft 220 and disk member 220 are preferably made of plastic, but may alternately be made of metal, composites, or other materials.

In another embodiment, shaft 220 is retained in position relative to cap member 240, upper disk member 230, and/or disk member 210 by way of an E-ring, cotter pin, retaining ring, or other retaining device (not shown) installed on shaft 220.

In one embodiment, upper disk member 230 has a generally flat, round shape with a bottom surface 230*a*, a top surface 230*b*, and centrally-located upper disk opening 232 extending therethrough along a central axis 231 of upper disk member 230. Preferably, central axis 231, shaft axis 221, and central longitudinal axis 124 are the same axis. Located radially between upper disk opening 232 and an outside edge 234 is an annular recess 236 formed axially into top surface 230*b*. Annular recess 236 is sized to receive ends 256 of tether connector 250 and permit tether connector 250 to rotate about central axis 231 with ends 256 partially received therein. Tether connector 250 is discussed in more detail below. In one embodiment, upper disk opening 232 is sized to receive shaft 220 with shaft protrusion 226 disposed within upper disk opening 232. In another embodiment, a bottom surface recess 235 (not visible; shown in FIG. 6) extends axially into bottom surface 230*a* of upper disk member and is sized to receive shaft protrusion 226. In this embodiment, busing 226 is received in bottom surface recess 235 rather than in upper disk opening 232.

An axial cross-section of cap member 240 is illustrated in a perspective view in FIG. 5. FIG. 5A illustrates a top view of cap member 240. In one embodiment, cap member 240 has a round, generally disk-like shape with a bottom surface 240*a*, a top surface 240*b*, and a centrally-located cap aperture 242 extending axially therethrough. In one embodiment, cap aperture 242 is a bore that extends through cap member 240 and has a single bore diameter 244. In such an embodiment, the single bore diameter 244 is larger than the diameter of shaft body 222 but smaller that the diameter of catch surface 224*a* so that catch surface 224*a* of shaft 220 engages top surface 240*b* when head 224 returns to its normally-uncompressed state after passing through cap aperture 242. Engagement of catch surface 224*a* and top surface 240*b* retains cap member 240 on shaft 220.

Figure 6:
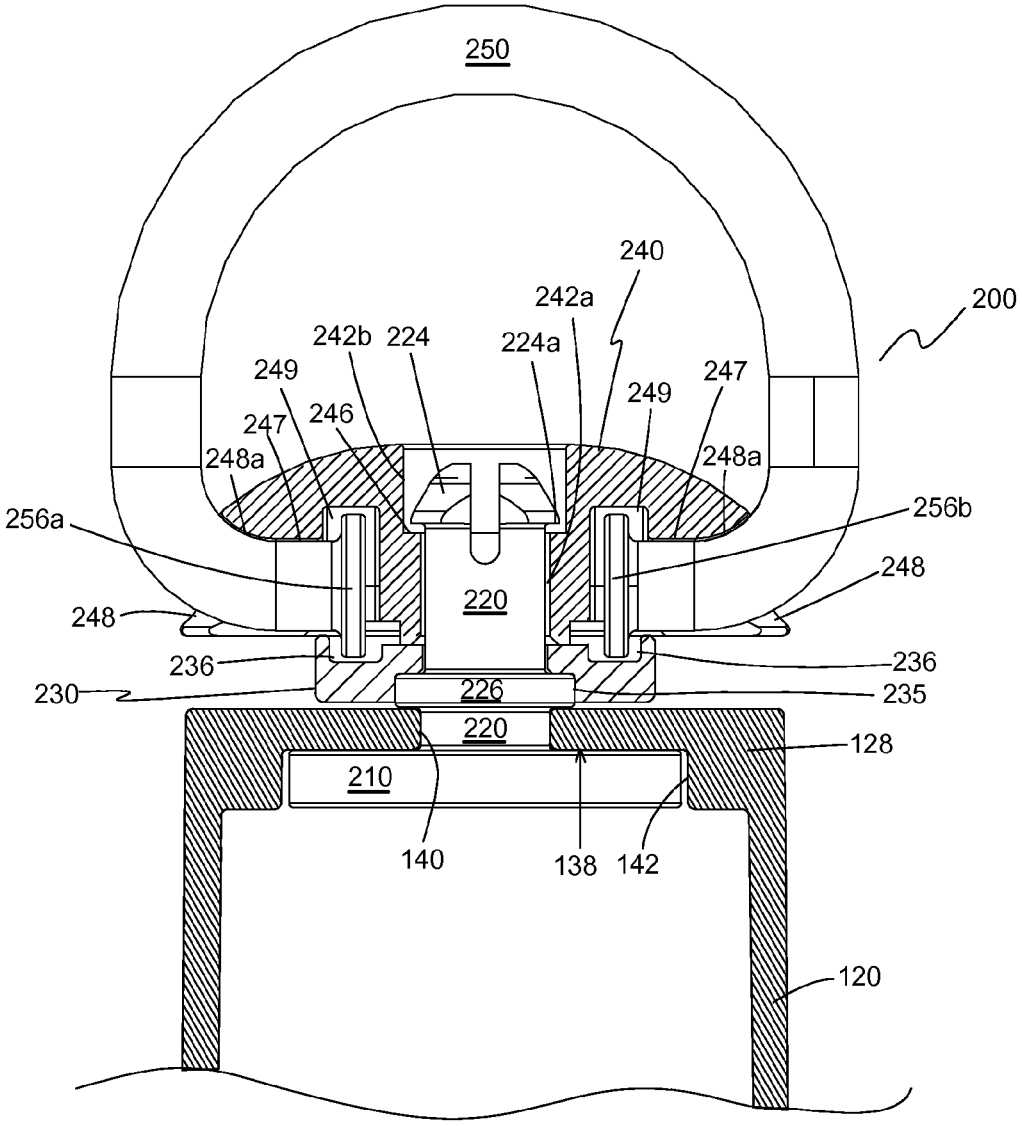
FIG. 6 illustrates a front, partial-sectional view of the connector assembly of FIG. 5 shown installed on a holder body.

In another embodiment, cap aperture 242 has a plurality of coaxial bores with different bore diameters 244, where the intersection between a first bore 242*a* (e.g., a smaller bore diameter 244*a*) with a second bore 242*b* (e.g., a larger bore diameter 244*b*) defines a bore shoulder 246 as more clearly shown in FIG. 6. Bore shoulder 246 provides a surface to engage catch surface 224*a* of shaft 220. Thus, shaft 220 creates a snap fit with cap member 240, where head 224 engages bore shoulder 246 to retain cap member 240 on shaft 220. Therefore, head 224 of shaft 220 can be configured and sized to remain within second bore 242*b* or to otherwise not extend from cap aperture 242 beyond top surface 240*a*.

In yet another embodiment, cap aperture defines at least one recess (not shown) formed or machined into a wall of cap aperture 242. An example of such a recess is a slot extending circumferentially (i.e. annularly) at least partially around cap aperture 242 and having a diameter greater than bore diameter 242. A slot or recess may be used, for example, when shaft has spring-biased ball or pin that is configured to extend from shaft 220 into the recess to retain cap member 240 on shaft 220.

In one embodiment, cap member 240 has side openings 247 that each extend transversely (e.g., perpendicularly) into cap member 240 toward cap aperture 242 and central axis 231. Preferably, an entrance 248 to each side opening 247 is recessed into cap member 240 and shaped to permit rotation of tether connector 250 about side openings 247. One example of entrance 248 is a countersink or conical hole machined or formed into cap member 240 at side openings 247. Another example of entrance 248 is one or more channels that intersect side opening 247 and extend transversely thereto. Such a channel may be made, for example, by machining or drilling into cap member 240 near side opening 247 at an angle transverse to side opening 247, where the channel intersects side opening 247. In one embodiment, entrance 248 has an upper channel 248*a* and at least one side channel 248*b*. Preferably, channels 248*a*, 248*b* receive tether connector 250 and provide a preferred stopping point for tether connector 250 as it rotates about side openings 247 due to cap member 240 causing ends 254 of tether connector 250 to separate slightly more at points of rotation between channels 248*a*, 248*b*. Thus, connector 250 preferably occupies one of channels 248*a*, 248*b* and "snaps" to these positions due to its preference to return to its non-expanded state when rotated to occupy a channel 248.

In one embodiment, cap member 240 optionally has a ring-end recess 249 at an inside end 247*a* of one or both of side openings 247, where inside end 247*a* of side opening 247 is the end towards cap aperture 242. Ring-end recess(es) 249 extend axially into bottom surface 240*a* and define an open space in communication with side opening 247. Ring-end recess(es) 249 are sized and configured to accommodate an enlarged end 256 of tether connector 250 (discussed in more detail below). In one embodiment, ring-end recess 249 have a rectangular or arched cross-sectional shape as viewed from side opening 247 that permits insertion of enlarged end 256 of tether connector 250 in an axial direction from bottom surface 240*a*.

In one embodiment, top surface 240*b* is domed. A domed top surface 240*b* reduces contact between a tether (400) or other line (shown in FIG. 7) passing through tether connector opening 251 and along the perimeter edge 240*a* of cap member 240, thereby reducing wear on tether 400. A domed top surface 240*b* also provides more space for rotation of tether connector 250 about a pivot axis 266 that extends transversely to shaft 220 or central longitudinal axis 124, and preferably extends through side openings 247.

In one embodiment, cap member 240 includes a bore sidewall extension 243 extending around cap aperture 242 and extending axially from bottom surface 240*a*. In one embodiment, bore sidewall extension 243 abuts top surface 230*b* of upper disk member 230 between upper disk opening 232 and annular recess 236. In another embodiment, bore sidewall extension 243 is received in upper disk opening 232 to seat and position cap member 240 coaxially with upper disk member 230.

Referring again to FIG. 5, one embodiment of connector 250 substantially defines a closed or mostly-closed loop or ring with a connector opening 251. Tether connector 250 preferably has a D shape with a curved portion 252 connected to a straight portion 254 as found, for example, on a D-ring. Other shapes for tether connector 250 are also acceptable, such as circular, rectangular, triangular, irregular, and others. Straight portion 254 includes a first straight portion 254*a* and a second straight portion 254*b* aligned with each other and separated at their respective ends 256*a*, 256*b* by a predefined distance 258 (e.g., an open D-ring). In one embodiment, ends 256*a*, 256*b* are optionally enlarged and sized to be at least partially received in ring-end recesses 249 of cap member 240. Tether connector 250 is preferably made of rigid plastic or metal, but may be made of other materials, such as composites, rubber, wire, cable, or other rigid or flexible materials.

Referring now to FIG. 6, a partial, cross-sectional, side view of connector assembly 200 is shown assembled with holder body 120. Holder body 120, upper disk member 230, and cap member 240 are illustrated as sections. Disk member 210 is seated in end recess 142 of holder body 120 and abuts inside surface 138 of second end 128. Shaft 220 is connected to disk member 210 and extends through end aperture 140 in second end 128, through upper disk member 230, through first cap aperture 242*a* of cap member 240, and is positioned with head 224 within second cap aperture 242*b* of cap member 240. Cap member 240 is retained in rotatable connection to shaft 220 by a snap fit with catch surfaces 224*a* against bore shoulder 246. Shaft protrusion 226 is received in bottom surface recess 235 of upper disk member 230 with upper disk member 230 preferably abutting shaft protrusion 226. Ends 256*a*, 256*b* of connector 250 are received between ring-end recesses 249 of cap member 240 and annular recess 236 of upper disk member 230. Tether connector 250 is adjustably retained in an upright position with tether connector 250 engaging upper channels 248*a* on entrance 248 of side openings 247 in cap member 240.

Figure 7:
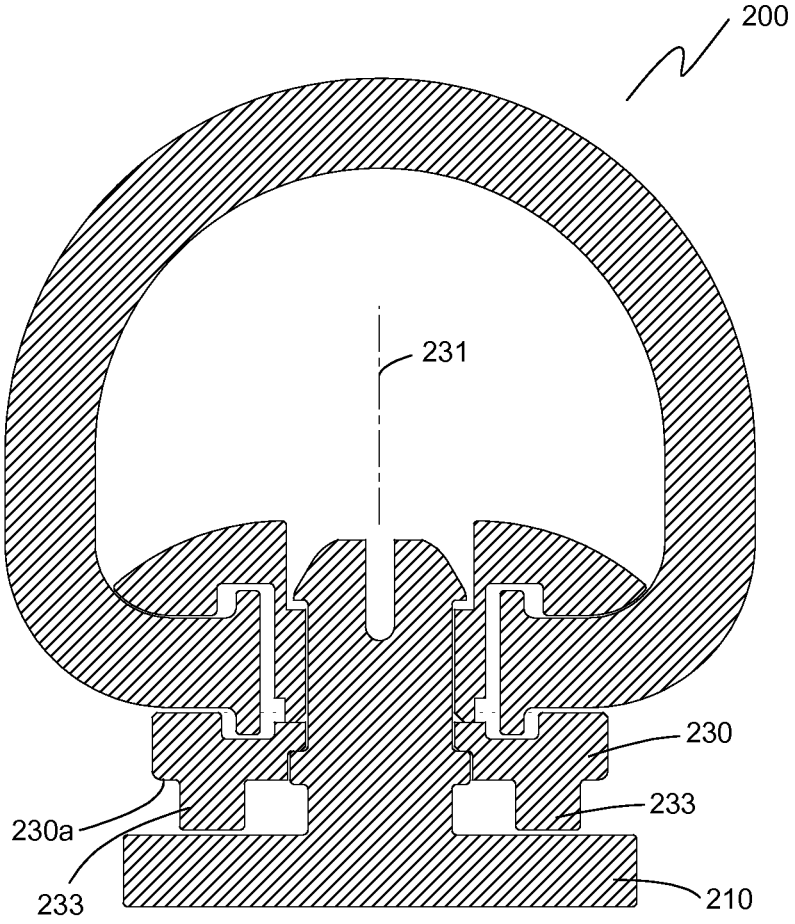
FIG. 7 illustrates a cross-sectional view of another embodiment of a connector assembly of the present invention showing feet extending from a bottom surface of the upper disk member.

Referring now to FIG. 7, a cross-sectional view of another embodiment of connector assembly 200 is shown. Compared to the embodiment shown in FIG. 6 discussed above, upper disk member 230 here includes a plurality of feet 233 extending axially from bottom surface 230*a* towards disk member 210 and substantially parallel to central axis 231. Feet 233 are sized to extend through feet openings 141 in second end portion 129 (shown in FIG. 8) to abut or terminate in close proximity to disk member 210.

Figure 8:
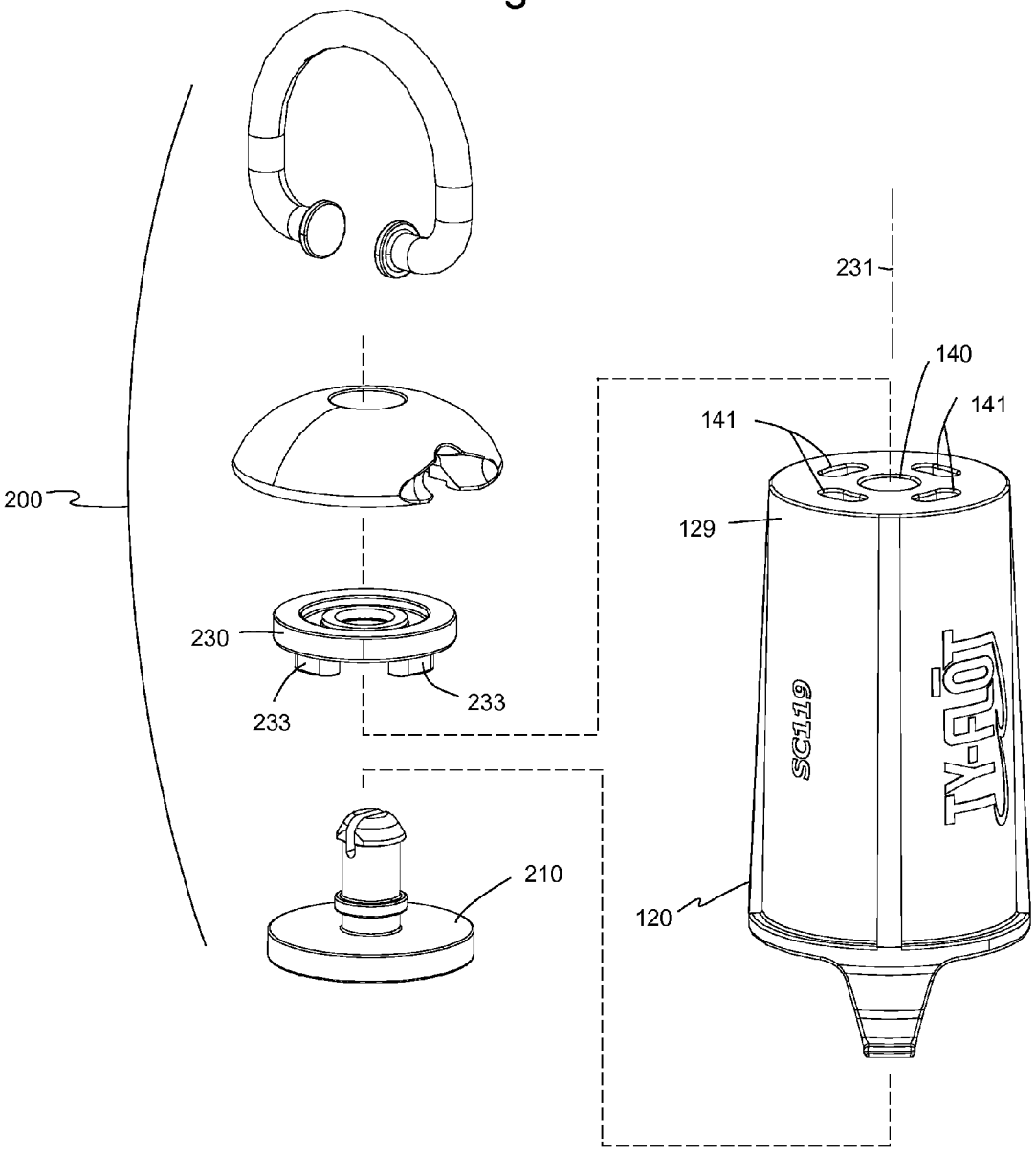
FIG. 8 illustrates a perspective assembly schematic of the connector assembly of FIG. 7 and one embodiment of a holder body that includes feet openings in the second end.

Referring now to FIG. 8, a perspective assembly schematic is shown of connector assembly 200 of FIG. 7 and one embodiment of holder body 120. As discussed above, upper disk member 203 includes a plurality of feet 233. Second end portion 129 of holder body 120 defines a plurality of feet openings 141 spaced apart from each other in a circular array around end aperture 140. Feet openings 141 extend through second end portion 129 and are sized and shaped for feet 133 of upper disk member. By extending through openings in second end portion 129, upper disk member 230 is prevented from rotating relative to holder body 120, therefore reducing wear on holder body 120. When feet 133 extend through second end portion 129 to contact disk member 210, rotational wear caused by disk member 210 is borne by feet 133 rather than holder body 120.

Figure 9:
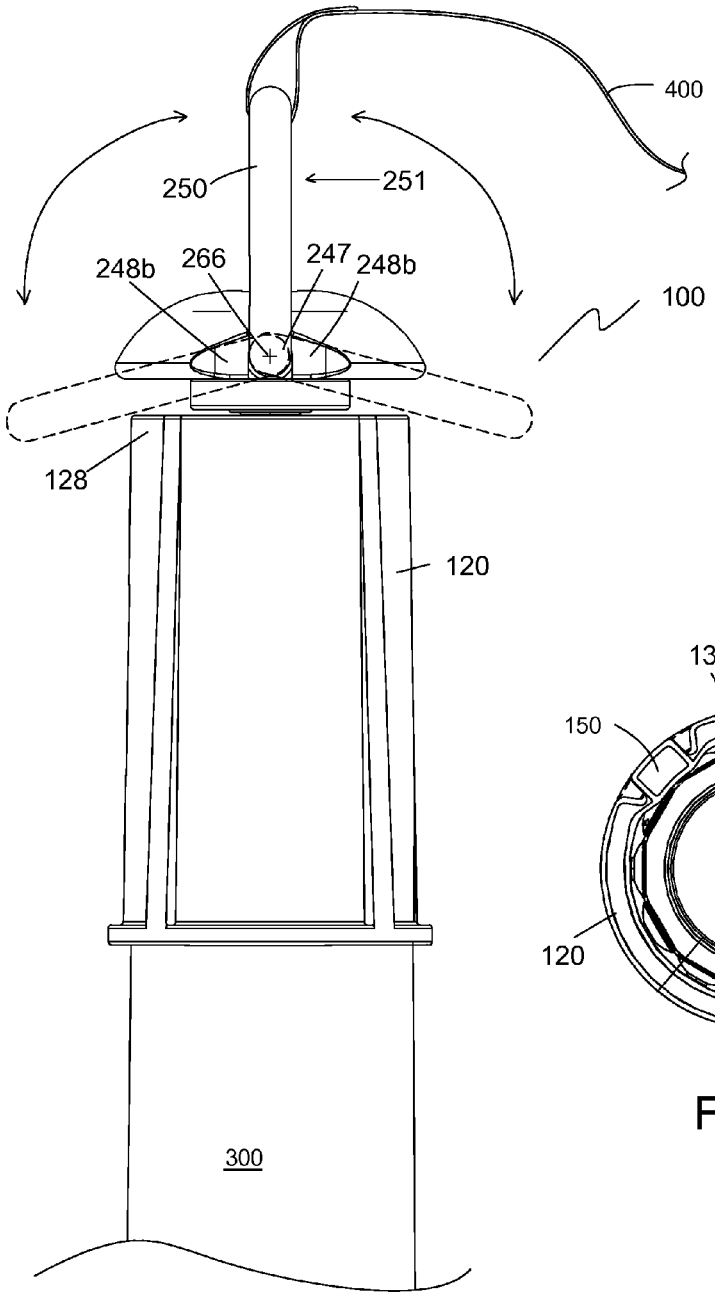
FIG. 9 illustrates another embodiment of a tool holder of the present invention shown installed on the non-working end of a tool and including a tether coupled to the connector assembly.

Referring now to FIG. 9, a side view of an embodiment of tool holder 100 is illustrated without tabs 150. Tool holder 100 is installed on the non-working end of a hand tool 300. Tether connector 250 is in an upright position and connected to a tether 400. Tether connector 250 in one embodiment is capable of moving between positions shown in dashed lines where connector 250 is received in side channels 248*b* of cap member 240. This range of movement is achieved by connector 250 pivoting about pivot axis 266 that extends through side openings 247. When tether connector 250 is sufficiently large, it potentially can pivot 360° about pivot axis 266 provided that holder body 120 (and any tool attached to tool holder 100) can pass through ring opening 251. The feature of the tether connector 250 pivoting about pivot axis 266 is an advantage of the present invention because it permits tether connector 250 to fold down on either side at second end 128 of holder body 120. This feature minimizes interference with the usefulness of tool holder 100 by making hand use more comfortable since tether connector 250 is not sticking out or extending axially away from second end 128 when pivoted into the fold down position. Another advantage of the pivoting action of tether connector 250 is that when it is in a fold down position, it serves as an anti-roll mechanism. Where the outer bounds of tether connector 250 extend beyond the outer circumference of holder body 120 at second end 128, tether connector 250 in a fold down position prevents a tool such as screwdriver from continuously rolling along a surface when the tool with tool holder 100 is placed on a flat surface.

Figure 10:
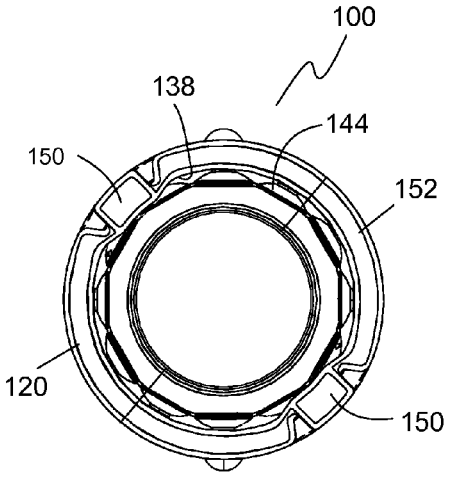
FIG. 10 illustrates a bottom-end view of an embodiment of the tool holder of FIG. 1 showing suction cups on an inside surface of the holder body.

Referring now to FIG. 10, a bottom view of tool holder 100 shows a plurality of suction cups 144 on inside surface 138 of holder body 120. Tabs 150 extend axially from first end 126 and preferably do not radially extend beyond the outer diameter of rim 132.

Figure 11:
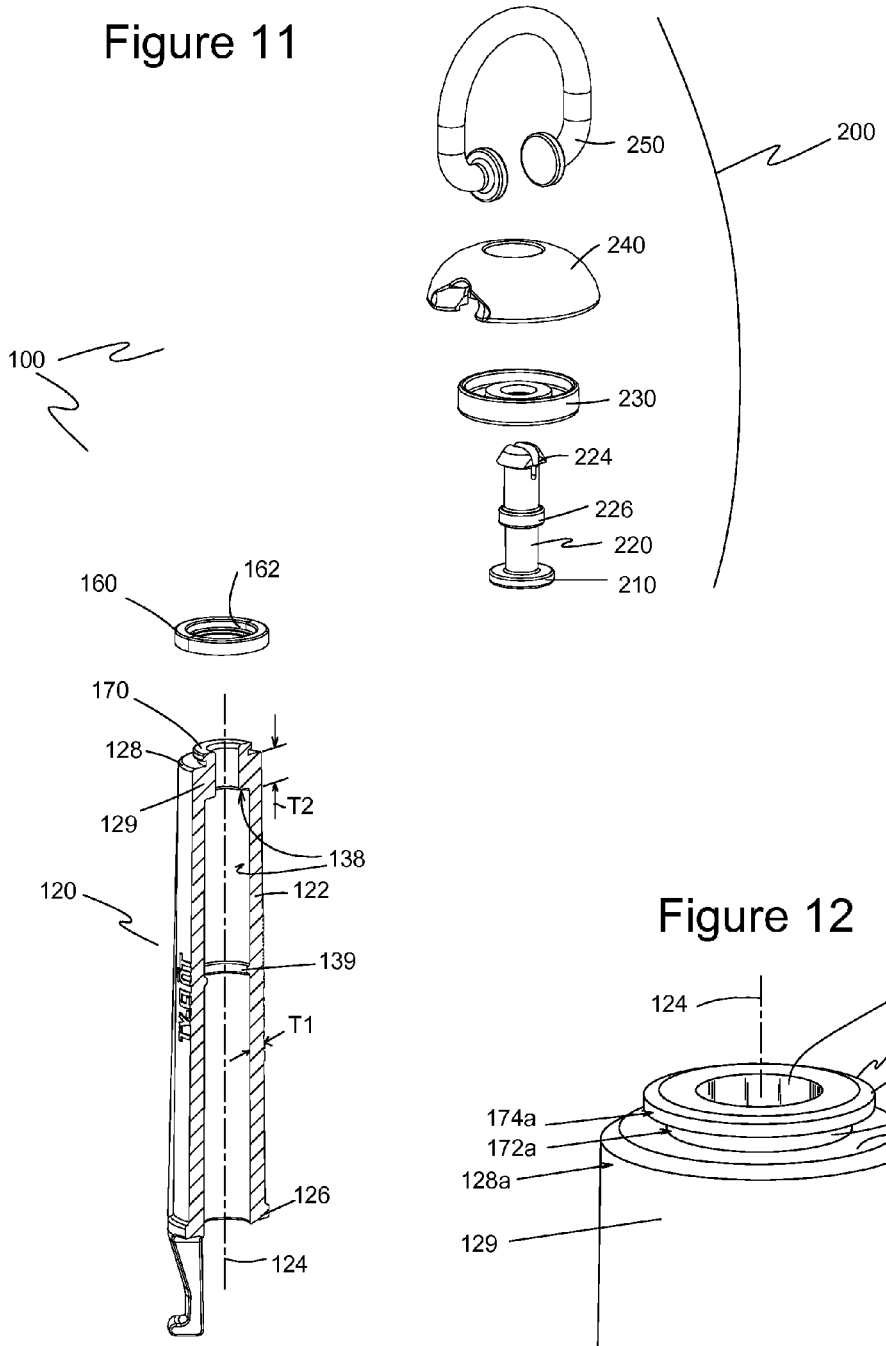
FIG. 11 illustrates a perspective view of one embodiment of a tool holder shown in disassembled form with the connector assembly shown exploded and the holder body shown as a cross section for clarity.

Referring now to FIG. 11, a perspective view shows another embodiment of tool holder 100 in disassembled form and that includes a connector assembly 200, holder body 120, and a reinforcing member 160. Connector assembly 200 is shown exploded. A portion of holder body 120 is shown as a cross section for clarity.

As discussed above for other embodiments, connector assembly 200 includes shaft 220 with disk member 210, head 224, and shaft protrusion 226 extending from shaft 220 and located between disk member 210 and head 224. Connector assembly also includes upper disk member 230, cap member 240, and tether connector 250. Shaft 220 is sized to extend through end aperture 140 in second end portion 129 so that disk member 210 abuts inside surface 138 of second end portion 129 and with shaft protrusion 226 positioned beyond flange member 170 on second end 128. In some embodiments, shaft protrusion 226 is positioned to abut or be closely adjacent to flange member 170.

As shown in FIG. 11 second end portion 129 of one embodiment of holder body 120 has an increased axial thickness T2 compared to wall thickness T1. The increased axial thickness T2 strengthens second end portion 129 to prevent disk member 210 from pulling through end aperture 140.

In some embodiments, inside surface 138 of sidewall includes an annular rib or sidewall protrusion 139 that extends radially inward towards central longitudinal axis 124. In one embodiment, sidewall protrusion is positioned approximately halfway between first end 126 and second end 128. Sidewall protrusion 139 may extend in a continuous closed loop along inside surface 138. Alternately, sidewall protrusion 139 includes two or more distinct segments that are circumferentially spaced apart from one another. Sidewall protrusion serves several functions. Sidewall protrusion 139 provides additional grip on a tool inserted into holder body 120 at the location of sidewall protrusion 139 due to the reduced diameter of holder body 120 at that location. Also, sidewall protrusion 139 is capable of acting as a stop point for some tools inserted part way into holder body 120. For example, the user may wish to prevent a writing implement or other tool from being fully inserted into holder body 120 where holder body 120 exerts a grip strength on the tool beyond what the user deems appropriate for removal of the tool. For an implement inserted into holder body 120 past sidewall protrusion 139, sidewall protrusion 139 also is capable of reducing the ability of holder body 120 to form an air-tight seal between an implement and inside surface 138 since inside surface 138 is offset from the implement near sidewall protrusion.

Figure 12:
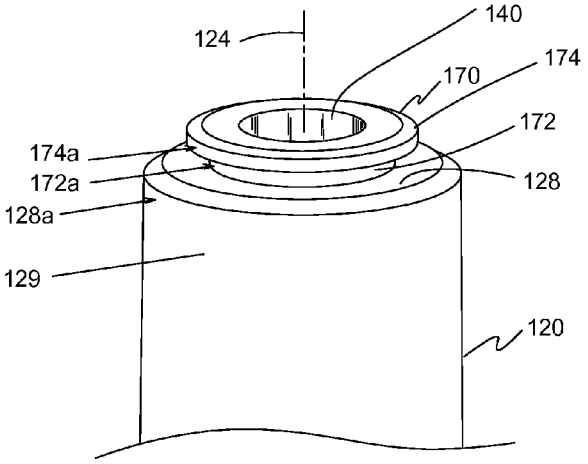
FIG. 12 illustrates a perspective view of a second end portion of one embodiment of the holder body with flange member.

Referring now to FIG. 12 a perspective view illustrates second end portion 129 of one embodiment of holder body 120 with flange member 170. Flange member 170 includes a flange neck portion 172 and a flange rim portion 174, where flange rim portion 174 is spaced apart from and connected to second end 128 by flange neck portion 172. In one embodiment, flange neck portion 172 and flange rim portion 174 are both annular and centered about central longitudinal axis 124 with end aperture 140 extending through flange member 170. Stated differently, flange neck portion 172 extends coaxially with end aperture 140 between second end 128 and flange rim portion 174. In some embodiments, flange rim portion 174 and flange neck portion 172 have a rectangular, hexagonal, ellipsoid, or other profile shape as viewed looking in an axial direction at second end 128. Flange rim portion 174 extends radially beyond flange neck portion 172, such as having a flange rim outer diameter 174*a* that is greater than a flange neck outer diameter 172*a*. In some embodiments as shown, for example, in FIGS. 11-12, flange rim outer diameter 174*a* is smaller than second end outer diameter 128*a*. This configuration is useful when flange rim portion 174 is received in reinforcing member recess 162 of reinforcing member 160.

Reinforcing member 160 is configured to be installed on flange member 170, such as around flange neck portion 172 between second end 128 and flange rim portion 174. Reinforcing member 160 is another structure that strengthens second end portion 129 to prevent disk member 210 from pulling through end aperture 140. Reinforcing member 160 can be installed on holder body that either has or lacks an increased axial thickness T2 at second end portion 129.

Reinforcing member 160 can be an annulus or ring, a split ring, a circlip, or other fixed or adjustable structure that can be installed on flange member 170. In one embodiment, reinforcing member 160 has a ring shape with a reinforcing member recess 162 extending axially into reinforcing member 160, where reinforcing member recess 162 is sized to receive flange rim portion 174 therein. As such, flange rim portion 174 can be flush with or set axially below reinforcing member 160 as desired. As will be discussed in more detail below, other embodiments of reinforcing member 160 attach to flange member 170 with flange rim portion 174 extending radially to overlap reinforcing member 160. Since holder body 120 is made of a flexible, resilient material, flange rim portion 174 can be deformed or forced through the opening of reinforcing member 160 so that reinforcing member 160 seats itself about flange neck portion 172.

Figure 13:
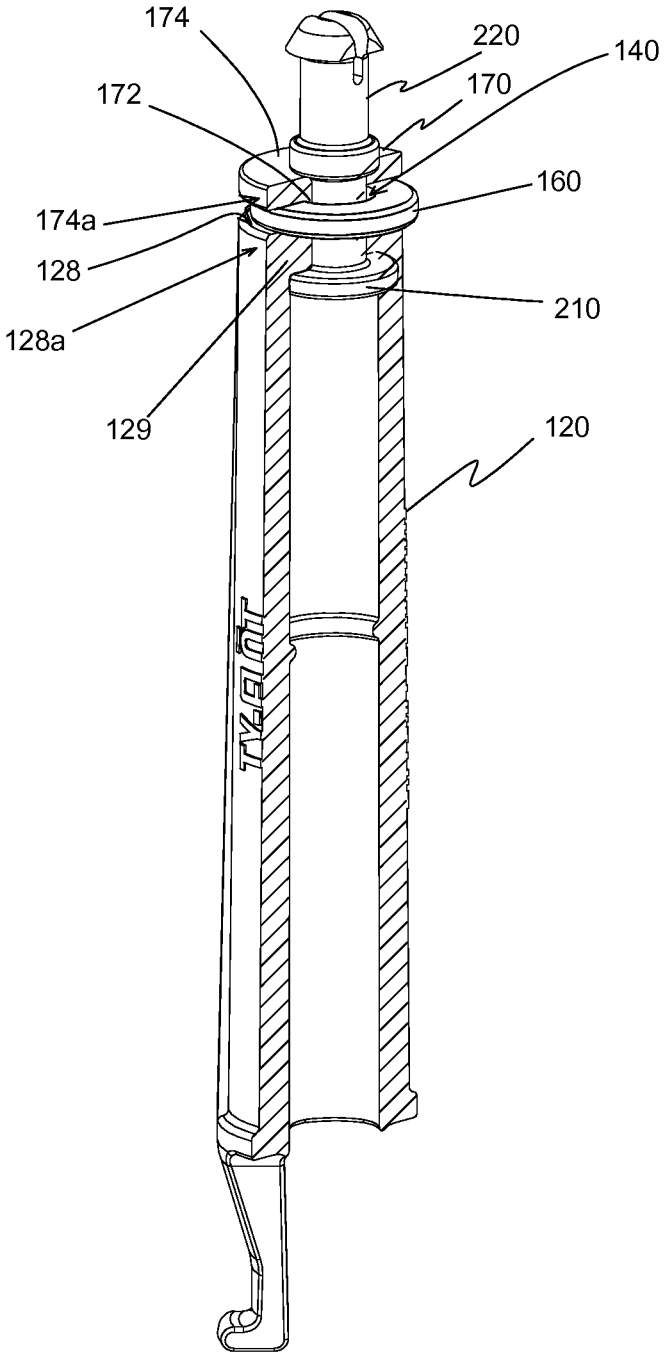
FIG. 13 illustrates perspective view of the holder of FIG. 9 shown assembled and with the holder body shown as a cross section for clarity.

Referring now to FIG. 13, a perspective view shows a cross section of another embodiment of holder body 120 including flange member 170. Reinforcement member 160 is installed between second end 128 and flange member 170 with shaft 220 extending through end aperture 140. In this embodiment, flange rim outer diameter 174*a* is substantially equal to second end outer diameter 128*a*. As such, reinforcement member 160 is received between flange rim portion 174 and second end 128 of holder body 120 with flange neck portion 172 extending through reinforcement member 160.

Embodiments of holder body 120 that include flange member 170 and reinforcement member 160 allow tool holder 100 to carry heavier loads. When installed, disk member 210 indirectly contacts reinforcement member 160 through second end portion 129. As a load is applied to tether connector 250 (shown in FIG. 9) and therefore to shaft 220, the force of disk member 210 is not entirely borne by second end portion 129, which is made of a pliable material and has end opening 140 in some embodiments. Thus, reinforcement member 160 enables tool holder 100 to be used on heavier tools without failure.

In use, tool holder 100 is installed on the non-working end of a hand tool 300 with holder body 120 frictionally engaging and gripping hand tool 300. When holder body has suction cups 144, it additionally grips tool 300 due to suction cups 144 forming a vacuum seal with tool 300. Thus, tool holder 100 is securely retained on tool 300 and can be used, for example, as a retaining or safety device to prevent accidental drops of tool 300. The user clips, couples, or attaches a tether 400, lanyard, safety line, or connector to tether connector 250 coupled to second end 128 of holder body 120. The opposite end (not shown) of tether 400 is then attached, for example, to the user's safety harness, a structure, a tool belt, or other item.

To remove tool holder 100 from tool 300, the user breaks or reduces the grip between holder body 120 and tool 300 by pulling outward and/or upward (upward meaning axially away from hand tool 300) on one or more tabs 150. When tool holder 100 is not equipped with tabs 150, the user may instead grasp open end margin 152 and pull outward to break or reduce the grip between holder body 120 and tool 300.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A tool holder comprising:

a holder body having a generally cylindrical sidewall extending along a central longitudinal axis between an open first end and a partially-closed second end defining an end aperture extending axially therethrough, the holder body having an inside surface with an inner diameter and an outside surface with an outer diameter;

a flange member joined as a single unitary structure with the holder body at the partially-closed second end and having the end aperture extending therethrough, wherein the flange member has a flange neck portion with a flange neck outer diameter smaller than the outer diameter of the holder body and a flange rim portion with a flange rim outer diameter larger than the flange neck outer diameter, wherein the flange neck portion and the flange rim portion each extend radially outward from the through-opening, and wherein the flange neck portion is positioned axially between the flange rim portion and the partially-closed second end of the holder body; and a reinforcing member installed on the flange neck portion;

wherein the holder body is made of a resilient, pliable material and constructed to receive and frictionally engage a non-working end of a tool inserted into the holder body through the open first end.

2. The tool holder of claim 1 further comprising: a tether connector assembly comprising:

a shaft member extending through the end aperture and through the partially-closed second end from a proximal end located in the holder body to a distal end located beyond the flange member;

a protrusion at the proximal end of the shaft member extending radially from the shaft member and having a protrusion surface shaped to engage the inside surface of the partially-closed second end of the holder body; and a tether connector attached adjacent the distal end and defining a closed loop.

3. The tool holder of claim 1 wherein the reinforcing member is generally annular and is installed about the flange neck between the flange rim portion and the second end portion of the holder body.

4. The tool holder of claim 1, wherein the inside surface of the holder body at the partially-closed second end is concave.

5. The tool holder of claim 1, wherein the holder body has one or more tabs extending axially from the open first end.

6. The tool holder of claim 1, wherein the holder body has a plurality of suction cups on the inside surface of the holder body.

7. The tool holder of claim 2, further comprising:

an annular upper disk member installed on the shaft member between the partially-closed second end of the holder body and the tether connector.

8. The tool holder of claim 7, wherein the partially-closed second end defines a plurality of feet openings arranged in a circular array about the end aperture; and wherein the protrusion has a disk shape and the upper disk member includes a plurality of feet extending axially from a bottom surface, the plurality of feet corresponding to and extending into the plurality of feet openings.

9. The tool holder of claim 8, wherein the plurality of feet extend through the plurality of corresponding feet openings to abut the protrusion at the proximal end of the shaft member.

10. The tool holder of claim 1, wherein the reinforcing member is selected from the group consisting of a ring, a circlip, a split ring, a washer, an annular disk, and a plate with a slot.

11. The tool holder of claim 2, wherein the reinforcing member is a closed ring sized to fit snugly between the partially-closed second end of the holder body and the flange rim portion.

12. The tool holder of claim 11, wherein the reinforcing member defines an annular recess sized to receive the flange rim portion therein.

13. The tool holder of claim 2, wherein the protrusion is a disk-shaped member having a face sized to abut the inside surface of the second end of the holder body.

14. The tool holder of claim 2, wherein the shaft member is a split shaft having a catch surface extending outwardly from the split shaft at a shaft portion located distally of the flange rim portion.

15. The tool holder of claim 1, wherein the flange rim outer diameter is smaller than the outer diameter of the holder body at the second end.

* * * * *